United States Patent [19]

Christine et al.

[11] Patent Number: 4,492,490

[45] Date of Patent: Jan. 8, 1985

[54] ROAD REPAIR SPREADER

[76] Inventors: David R. Christine, 925 Township Rd. 2408, R.D. #1; John F. Terry, Jr., 2488 State Rte. 39, both of Perrysville, Ohio 44864

[21] Appl. No.: 392,276

[22] Filed: Jun. 25, 1982

[51] Int. Cl.[3] ..... E01C 19/15

[52] U.S. Cl. ..... 404/108; 404/118; 298/17 R; 296/184

[58] Field of Search ..... 404/108, 109, 110, 105, 404/106, 101, 118, 96; 298/17 R, 1 R; 296/184; 239/657; 222/610

[56] References Cited

U.S. PATENT DOCUMENTS

| | | | |
|---|---|---|---|
| 2,005,896 | 6/1935 | Hurt | 404/108 X |
| 2,044,652 | 6/1936 | Walker | 222/610 |
| 2,870,923 | 1/1959 | Jewell, Jr. | 239/657 X |
| 3,091,999 | 6/1963 | MacDonald | 404/101 |
| 3,108,517 | 10/1963 | Fingland | 404/110 |
| 3,229,601 | 1/1966 | Philpott | 404/103 |
| 3,230,845 | 1/1966 | Mauldin | 404/110 |
| 3,479,755 | 11/1969 | Schropp | 404/101 X |
| 3,515,041 | 6/1970 | Murtaugh | 404/108 |
| 3,526,173 | 9/1970 | Brandstetter et al. | 404/108 |
| 3,884,395 | 5/1975 | Keenan | 404/108 X |
| 3,909,146 | 9/1975 | Hoffman | 298/17 R X |

FOREIGN PATENT DOCUMENTS

| | | | |
|---|---|---|---|
| 159801 | 11/1954 | Australia | 239/657 |
| 1382163 | 1/1975 | United Kingdom | 404/118 |

*Primary Examiner*—James A. Leppink
*Assistant Examiner*—Beverly E. Hjorth
*Attorney, Agent, or Firm*—Oldham, Oldham & Weber Co.

[57] ABSTRACT

The invention comprises a device which automatically spreads road repair material over a pothole or crack in a road. The device has a spreader which is attached to the rear of a moving vehicle, such as a dump truck, which optionally has a quantity of road repair material stored therein. The repair material is deposited on the road surface either in the crack or pothole or immediately behind it. The spreader then passes over the hole and either smoothes the repair or fills the hold by carrying the repair material into the hole and simultaneously smoothes it over. The device has adjustment means whereby the spreader can conform to the contour or grade of the road to aid in the smoothing process. Use of the device eliminates the manual labor involved in making a road repair, and also accomplishes the repair quicker than has heretofore been possible.

8 Claims, 4 Drawing Figures

ROAD REPAIR SPREADER

TECHNICAL FIELD

This invention lies in the art of road repair, and more particularly, the invention describes a device which aids in the application of road repair material, such as asphalt to a paved surface. Use of the device reduces the amount of manual labor necessary for proper application of the repair material while obtaining a better repair then with prior art apparatus and techniques.

BACKGROUND ART

Standard practice in the repair of roads and highways is to have a moving vehicle such as a dump truck, filled with road repair material, move slowly forward along the road with a crew of highway repairmen walking therebehind. The repair material is removed from the dumpster bed of the truck and deposited in road holes, cracks or the like by shoveling or the operation of a gate at the rear of the dumpster bed. The material, such as asphalt, is thereafter smoothed over by repair crews using shovels, rakes, and the like. Since the asphalt or other material is commonly maintained at a temperature of between 300° and 500° F., the job of smoothing out the road surface after patching is both tedious and exhausting, and it must be quickly performed before the repair material cools and hardens. Obviously, the vehicle can move only as fast as the road crew can smooth the patches over, thus the process of road repair by this method is quite slow. Further, depending upon the level of skill of the individual road worker, the finished patch may be uneven or otherwise not finished sufficiently to provide a smooth surface.

There is thus a need in the art for a method of road repair which eliminates the need for manual spreading of the repair material, and which can produce a smooth, evenly patched surface. The present invention meets this need by providing a mold board secured to the rear of the moving vehicle, which spreads and compacts the repair material automatically as it is drawn over the patch.

DISCLOSURE OF INVENTION

It is an object of the present invention to provide a device which permits the repair of potholes and cracks in a road without the need for manual labor.

It is another object of the present invention to provide a device, as above, which spreads road repair material automatically.

It is yet another object of the present invention to provide a device, as above, which follows the contour and grade of the road to produce an even, uniform patch of repair material.

It is still another object of the present invention to provide a device, as above, which effects repair of the road in shorter periods of time than previously.

Yet another object of the present invention is to provide a device, as above, which may automatically be raised from and lowered to the road surface by means of connection to a suitable, moving vehicle.

These objects and others which will become apparent as the detailed description proceeds, are achieved by: a road repair spreader, comprising: a mold board having at least one shaft pivotally secured thereto; a frame having a sleeve in slidable engagement with said shaft; a tray covering a portion of the area prescribed by said frame; and means for pivotal securement of said frame to the rear of a moving vehicle; wherein said mold board adjusts to the contours of the road and spreads said road repair material evenly thereby.

BRIEF DESCRIPTION OF DRAWINGS

For a fuller understanding of the objects, techniques, and structure of the invention, reference should be made to the following detailed description and accompanying drawings, wherein.

BEST MODE FOR CARRYING OUT THE INVENTION

Figure 1:
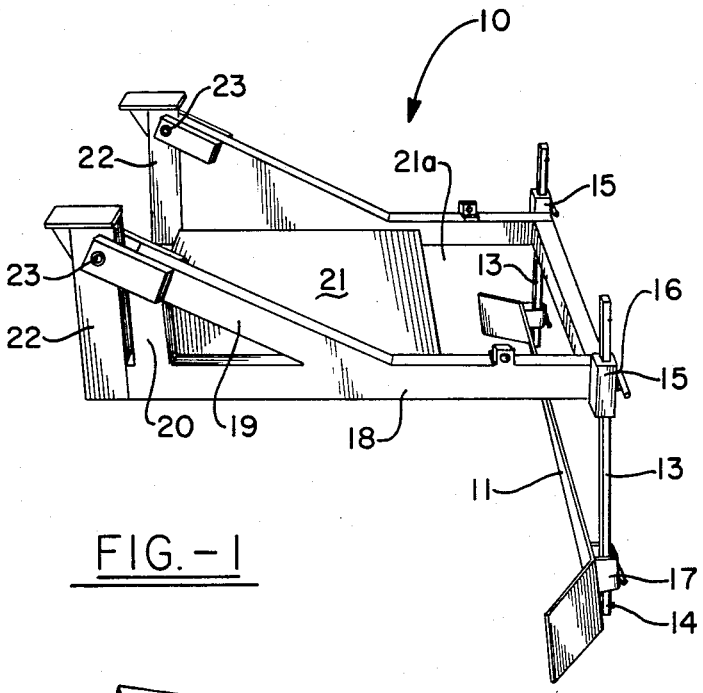
FIG. 1 is an isometric view of the road repair spreader of the invention.
Figure 2:
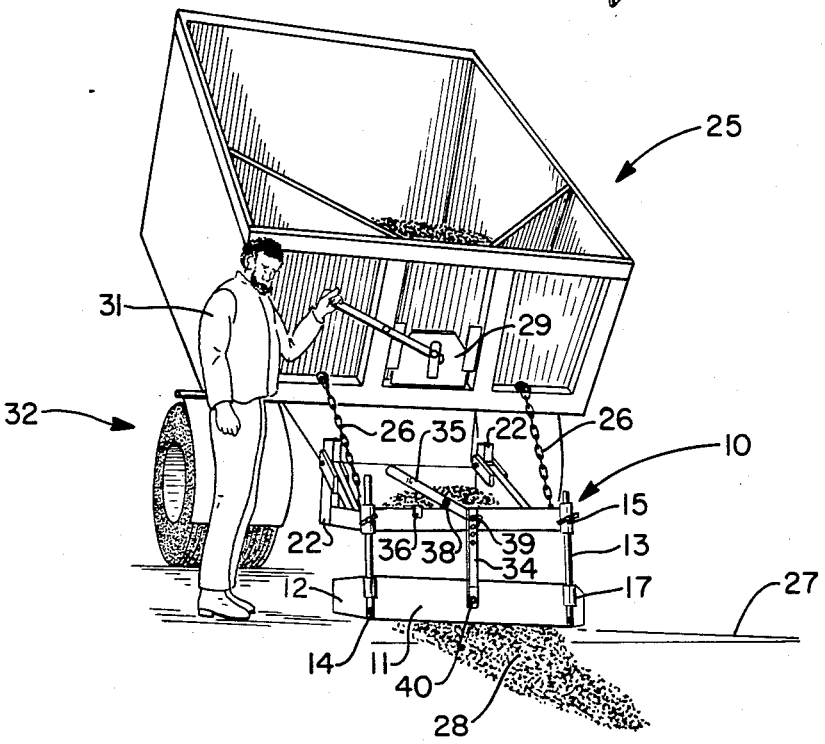
FIG. 2 is a view of the road repair spreader during operation.

FIGS. 1 and 2 illustrate the preferred embodiment of the invention wherein the road repair spreader is indicated generally by the number 10. A mold board 11 contacts the road surface in the manner shown in FIG. 2 and is drawn over a quantity of road repair material 28 as the vehicle to which the spreader 10 is attached moves forward. The mold board may be curvate or, as shown, planar, and optionally having end pieces 12 at either extremity which serve to contain the repair material to the desired area. The mold board varies in length from 4 to 8 feet and has a height of between 8 and 12 inches, dependent on application. End flaps 12 are angled forward in the direction of vehicle motion at between 20° and 45°.

Secured in a pivotal fashion to the mold board are one or more shafts 13 which can rotate about an axis perpendicular to the mold board within a limited arc prescribed by retention brackets 17. The pivotal securement may take the form of pins 14. A sleeve 15 located on a frame 18 receives each shaft and permits slidable movement therein. Alternatively, when desired, the shafts may be rigidly secured within the sleeves by set screws 16 which prevent slippage of the shafts out of the sleeves.

Frame 18 is rotatably secured to one or more brackets 22 mounted on the rear of a vehicle such as a dump truck 32 having a dumpster bed 25. Braces 19 and 20 aid in maintaining rigidity of the frame and provide a location for attachment to the brackets, which can consist of pins 23 which pass through both braces 19 and brackets 22. Two chains 26 are secured at one end to the frame and at the other to the rear of the dumpster bed 25 which can be tilted as shown in FIG. 2. This allows the frame 18 to assume a horizontal position by abutting against brackets 22. When dumpster bed 25 is so tilted, an operator 31 opens a gate 29 to allow discharge of repair material 28 onto the frame 18. A portion of the internal area of the frame is covered by a tray 21 which retains part of the repair material until a quantity has accumulated such as that an overflow occurs. The repair material thereafter falls through a slit **21*a* in the frame and onto the chuckhole or crack in the road which is to be filled. Use of tray 21** allows the operator to vary the amount of repair material which falls through the slit by shoveling out some of the accumulation on the tray. In this way, particularly large or deep holes can be filled.

Once the crack or pothole has been filled, forward movement of the vehicle brings the mold board 11 across the repair which is thereafter smoothed and evened out. The mold board may be perpendicular to the road surface, but is preferably angled forward up to 20°. Like the end flaps 12, the forward angle 27 aids in retaining the repair material 28 in the area of repair while rolling the repair material forward to obtain a packing action.

Because often times road surfaces are uneven, it is necessary for the mold board to have adjustment means for conforming to the road surface. The connection of the mold board 11 to the frame 18 affords this. As seen in FIG. 2, the lefthand side of the mold board is higher than the right as a result of repositioning of the interconnections between the frame and the board to conform the latter to the road surface, which may commonly have a crown or berm. Shafts 13 may slide up and down freely within sleeves 15 while simultaneously pivoting on pins 14, thus producing a type of floating action. Without the ability to adjust to the angle of the road surface, an even repair cannot be effected.

For various reasons, it may be necessary for the vehicle to move backward a short distance while the mold board is in position on the road surface, that is, without returning the dumpster bed 25 to the horizontal position. This maneuver becomes more difficult as the forward angle 27 of the mold board is increased as a design parameter. Above a certain angle, the mold board will "catch" on the road surface during backing, causing damage to the vehicle, the mold board or both. Consequently a lever rod 35 is provided which allows lifting of the mole board off the road surface *without* the dumpster bed being horizontal. As seen in FIG. 2, the lever rod 35 pivots about a fulcrum pin 38 secured to the frame 18 by suitable means such as a nut. The lever rod is pivotally connected at one end to a lift rod 34 having a plurality of apertures 37 which allow adjustment of lift rod length. Lift rod 34 is in turn pivotally secured to the mold board as shown. Force applied to the lever rod at the free end causes lift rod 34 to raise the mold board from the road surface, simultaneously allowing shaft 13 to slide upward in sleeves 15. The lever rod may then be secured in position by a retaining hook 36 or other means. Lever rod pin 39 and lift rod pin 40 may be of construction similar to the fulcrum pin, allowing free rotation of the lever and lift rods respectively. When released from the retaining hook, the lever rod will swing back, allowing the mold board to fall by gravity back onto the road surface.

Figure 3:
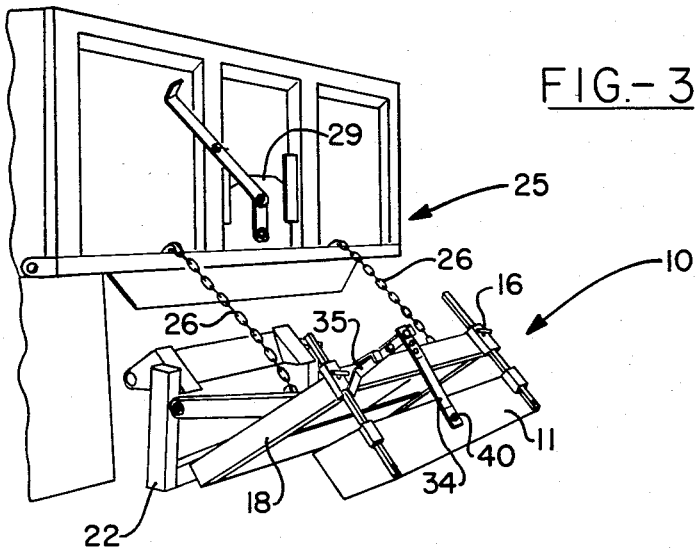
FIG. 3 is another view of the road repair spreader as mounted on a moving vehicle.

Turning to FIG. 3, it can be seen that when the spreader is not in use and thus when the dumpster bed is in the untilted position, the spreader is lifted off of the road surface. Shafts 13 are prevented from sliding out of sleeves 15 by the set screws 16 which are tightened prior to repositioning the dumpster bed.

Figure 4:
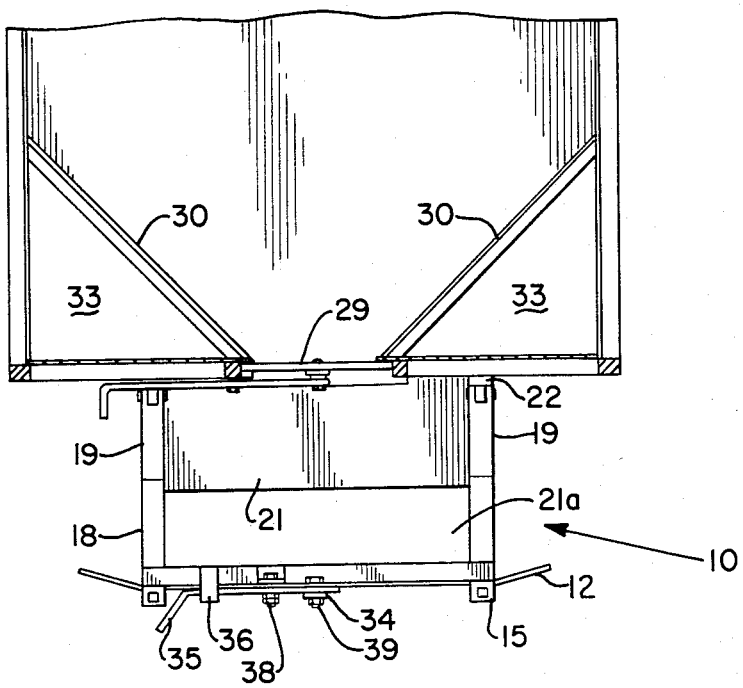
FIG. 4 is a diagrammatic top plan view of the structure of the invention as attached to the rear of the truck dump box.

FIG. 4 illustrates a preferred design for the discharge portion of the dumpster bed 25, wherein a pair of guides 30 prevent road repair material 28 from collecting in the corners 33 of the bed. The guides 30 have a height approximately equal to the height of the dumpster bed and are of a length which produces a sharp enough angle so that there is no bed space where repair material can collect. As seen from the figure, the guides 30 funnel the repair material to the gate 29.

While the preferred embodiment of the spreader 10 utilizes two shafts secured to the mold board, it is within the scope of the invention to use a different number of shafts, for example, one or three or more. If one shaft is used, it may be positioned at the center of the mold board 11. Further, the shafts need not be square in cross-section as illustrated, but may be circular, rectangular, triangular or L-shaped or indeed any other shape, so long as the cross-section allows the movement of the shafts described above. Similarly, the brackets 22 may be attached in various ways to the vehicle, such as for example, by flanges 24 and the like. In some applications, only one bracket may be needed. The invention is also not limited to the pivotal and rotational means described above. For example, bearings may be used instead of pins for securement of the frame to the brackets and for securement of the shafts to the mold board.

The frame 18 is preferably rectangular or square in shape but may be of another shape such as triangular if, for example, a single shaft is utilized. Because portions of the spreader 10 are exposed to the high temperatures of the asphalt or other material, metal is the preferred material of construction. Readily available materials may be used in the construction, such as pipe, angle iron and the like, the critical requirement being the ability to maintain structural integrity.

While in accordance with the Patent Statutes, only the best mode and preferred embodiment of the invention has been disclosed, it is to be understood that the invention is not limited thereto or thereby. Therefore, for a fuller understanding of the scope of the invention, reference should be made to the following appended claims.

What is claimed is:

1. A road repair spreader, comprising:

a frame adapted for attachment to a vehicle;

first and second sleeves affixed to said frame in spaced-apart relationship to each other;

a mold board;

first and second shafts having first ends thereof respectively slidingly received by said first and second sleeves and second ends thereof pivotally connected to said mold board; and wherein said shafts pass through brackets on said mold board, said brackets restricting pivotal movement of said shafts.

2. The road repair spreader according to claim 1 wherein said frame receives a tray along an area of a bottom portion thereof.

3. The road repair spreader according to claim 1 which further includes locking means associated with each said sleeve for selectively securing said shafts in their associated sleeves and preventing sliding action therebetween.

4. The road repair spreader according to claim 3 wherein said locking means comprises a setscrew received by each said sleeve.

5. A road repair spreader according to claim 1, wherein said mold board is planar and is tilted forward in the direction of movement of said vehicle at an angle of between 0° and 20° from the perpendicular to the road surface; and wherein said mold board has an end flap at either extremity.

6. The road repair spreader according to claim 5 wherein said flaps form an angle with said mold board of between 20° and 45°.

7. A road repair spreader according to claim 1, which further includes means for pivotal securement of said frame to the rear of said vehicle, comprising a pair of brackets each having a pin which passes through the bracket and a brace on said frame.

8. A road repair spreader according to claim 1, wherein said spreader includes a fulcrum pin secured to said frame;

a lever rod which pivots on said fulcrum pin;

a variable length lift rod pivotally secured at one end to said lever rod and at the other end to said mold board; and a retaining hook attached to said frame;

wherein a downward force applied to the free end of said lever rod causes said lift rod to raise said mold board from the road surface; and wherein said free end of said lever rod may be releasably secured on said retaining hook.

* * * * *